US005133192A

United States Patent [19]

Overton et al.

[11] Patent Number: 5,133,192

[45] Date of Patent: Jul. 28, 1992

[54] FUEL VAPORIZER

[75] Inventors: Dennis L. Overton, Bristol; Kenneth R. Langley, Wotton-under-Edge; Philip J. Millener, Bristol, all of England

[73] Assignee: Rolls-Royce plc, England

[21] Appl. No.: 575,816

[22] Filed: Aug. 31, 1990

[30] Foreign Application Priority Data

Aug. 31, 1989 [GB] United Kingdom ..... 8919723
Oct. 9, 1989 [GB] United Kingdom ..... 8922673
Jul. 23, 1990 [GB] United Kingdom ..... 9016097

[51] Int. Cl.[5] ..... F23R 3/32; F02C 7/224

[52] U.S. Cl. ..... 60/738; 60/742; 431/210

[58] Field of Search ..... 60/738, 736, 737, 742; 431/210, 166; 239/132.3, 132.5

[56] References Cited

U.S. PATENT DOCUMENTS 2,982,098 5/1961 Vickery ..... 60/738
3,626,444 12/1971 Caruel ..... 60/738
3,724,207 4/1973 Johnson .
3,757,522 9/1973 Caruel et al. ..... 431/210
3,869,865 3/1975 Lacroix et al. ..... 239/132.3
4,742,684 5/1988 Sotheran ..... 60/738

FOREIGN PATENT DOCUMENTS 635512 4/1950 United Kingdom .
1280715 7/1972 United Kingdom .
1427540 3/1976 United Kingdom .
1537671 1/1979 United Kingdom .
2004048 3/1979 United Kingdom ..... 60/738
2035540 6/1980 United Kingdom .
2215029 9/1989 United Kingdom .

*Primary Examiner*—Richard A. Bertsch
*Assistant Examiner*—Timothy S. Thorpe
*Attorney, Agent, or Firm*—Oliff & Berridge

[57] ABSTRACT

A fuel vaporizer is formed from two concentric tubes. A mixture of fuel and air having a high proportion of fuel passes along the annular space between the two tubes while air alone passes along the inner tube.

8 Claims, 4 Drawing Sheets

FUEL VAPORIZER

FIELD OF THE INVENTION

This invention relates to a fuel vaporizer, particularly a fuel vaporizer for use in a gas turbine engine.

DESCRIPTION OF THE PRIOR ART

The prior art will be described with reference to the accompanying diagrammatic FIG. 1 which is a cross-section of a known fuel vaporizer 1 which is located in a fuel burning region 2 of a gas turbine engine bounded by a wall 3. The fuel vaporizer 1 comprises a hollow tube of circular cross-section and of a substantially U-shape penetrating the wall 3 at one end 6.

The pressure within the fuel burning region 2 is arranged to be lower than on the other side of the wall 3 so that air outside the fuel burning region 2 passes through the fuel vaporizer 1 and into the fuel burning region 2. A fuel injector 4 sprays fuel denoted by arrows 5 into the airstream passing through the fuel vaporizer 1.

The fuel burning region 2 is hot and this heat is transferred to the fuel vaporizer 1, the fuel vaporizer 1 in turn transfers this heat to the fuel 5 passing through it. As a result the tubular wall of the fuel vaporizer 1 is cooled below the temperature of the fuel burning region 2 and the fuel 5 is vaporized so that a mixture of air and fuel vapour leaves the free end 7 of the fuel vaporizer 1 and is then burnt in the fuel burning region 2.

It is generally desirable to increase the burning temperature, that is the temperature within the fuel burning region 3, within gas turbine engines to increase their efficiency, and this produces a problem.

As the burning temperature increases the operating temperature of fuel vaporizer 1 increases until it is so weakened by temperature that it can no longer withstand the mechanical stresses upon it and breaks up. This can be prevented by increasing the amount of fuel being injected into the airstream by the fuel injector 4, this increases the amount of cooling of the fuel vaporizer 1, lowering its temperature further below that of the fuel burning region 2 and thus preventing its break up.

Unfortunately, despite the fact that the total ratio of fuel to air within the fuel burning region can be adjusted to any desired value it has nevertheless been found that if the ratio of fuel to air in the mixture leaving the fuel vaporizer 1 is too high black smoke will be emitted by the engine. This is often undesirable for visibility and environmental reasons.

Thus the problem may be encountered that if the engine is not to emit black smoke its burner temperature must be limited and the engine's efficiency is as a result reduced.

BRIEF SUMMARY OF THE INVENTION

The present invention was intended to produce a fuel vaporizer at least partially overcoming this problem.

This invention provides a fuel vaporizer comprising a fuel vaporizer comprising a first tube, a second tube and fuel injection means, the second tube being located within the first tube and defining a space between the two tubes to allow a first gas flow to flow in the space between the two tubes and a second gas flow to flow within the second tube, the two tubes and the fuel injection means being arranged so that, in use, the first gas flow contains a higher proportion of fuel than the second gas flow.

This solves the problem by permitting it to operate at a low overall fuel air ratio while allowing adequate cooling.

Preferably the second gas flow contains substantially no fuel.

BRIEF DESCRIPTION OF THE DRAWINGS

A fuel vaporizer embodying the invention will now be described, by way of example only, with reference to the accompanying drawings in which.

DETAILED DESCRIPTION

Figure 1:
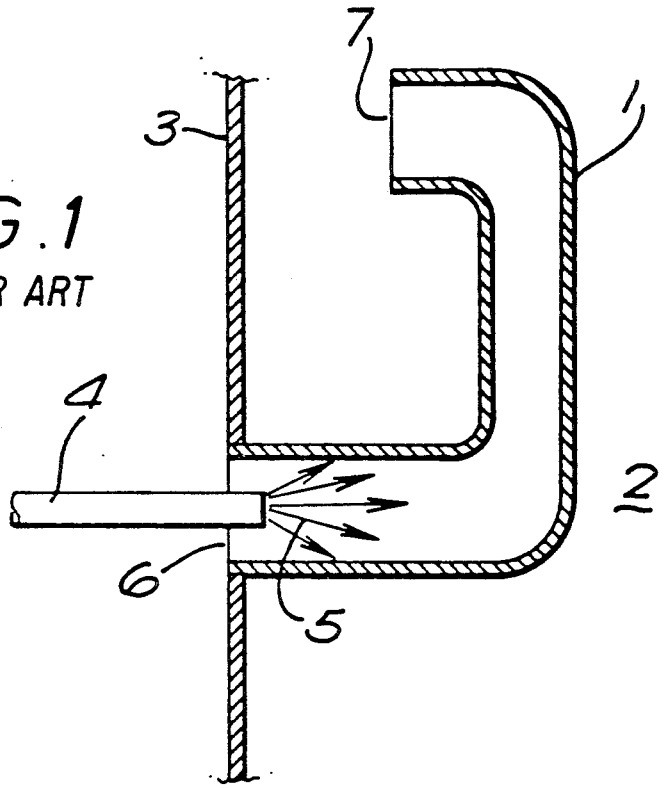
FIG. 1 PRIOR ART
FIG. 1 shows a cross-section of a prior art fuel vaporizer.

A fuel vaporizer 8 is within a fuel burning region 2 bounded by a wall 3. This is a burner can within a gas turbine engine. A fixed end 12 of the fuel vaporizer 8 is secured about the perimeter of a hole 13 in the wall 3. The pressure within the fuel burning region 2 is less than the air pressure on the other side of the wall 3, as a result air passes through the fuel vaporizer 8 into the fuel burning region 2.

The fuel vaporizer 8 is formed by an outer circular tube 9 and a coaxial circular inner tube 10, defining between them an annular channel 11. Six fins 15 linking the two tubes 9 and 10 are spaced around the annular channel 11 and extend parallel to the axis of the tubes 9 and 10. The fuel vaporizer 8 has three distinct sections starting from the fixed end 12, there is a first, entry, section 16 comprising the outer tube 9 only, a second, main, section 17 comprising both the outer and inner tubes 9 and 10 respectively, and a third, exit, section 18 again comprising the outer tube 9 only and terminating in a free end 19.

A fuel injector 14 passes along the axis of the outer tube 9 and terminates in a plurality of fuel spraying nozzles 20 within the first, entry, portion 16 of the fuel vaporizer 8.

The fuel spray nozzles 20 spray fuel into the airflow passing through the fuel vaporizer 8 in the directions of the arrows 22. These directions are not parallel to the axis of the outer tube 9 and are arranged so that all of the liquid fuel passes into the annular channel 11 between the inner and outer tubes 10 and 9 and effectively no liquid fuel passes into a circular channel 21 inside the inner tube 10. In practice a very small amount of fuel will inevitably pass along the circular channel 10, but this amount is negligible. As a result the ratio of fuel to air passing down the annular channel 11 in the second, main, section of the vaporizer 8 is very high, a mass ratio of 2 parts air to one part fuel being used. There must be a fuel air mixture in this annular passage 11 however, if pure fuel were to be used it would be likely to be "cracked" by the heat of the vaporizer outer tube 9 producing gummy or solid deposits which would disrupt or block fuel flow.

As the fuel air mixture passes along the annular channel 11 of the fuel vaporizer 8, the fuel absorbs heat from the vaporizer 8 and is vaporized, this heat absorption acting to cool the vaporizer 8. The fins 15 support the inner tube 10 within the outer tube 9, conduct heat so that the inner tube 10 acts as a heat sink for the outer tube 9 and ensures that the fuel air mixture remains evenly distributed around the annular channel 11.

On exit from the second, main, section of the vaporizer 8 the fuel air mixture coming from the annular channel 11 contains a very high proportion of fuel vapour while the air coming from the circular channel 21 contains virtually no fuel vapour. In the third, exit, section of the vaporizer 8 the outer tube 9 reduces in radius towards the free end 19 of the vaporizer 8 to cause mixing of the airstreams from the annular passage 11 and the circular passage 21 so that a homogenous mixture of fuel vapour and air at a mass ratio of 5 or more parts air to 1 part fuel vapour is emitted from the free end 19 of the vaporizer 8 into the fuel burning region 2 and is burnt.

The very high ratio of fuel to air in the annular channel 11 adjacent to the outer tube 9 causes a high rate of cooling of the outer tube 9, allowing the vaporizer 8 to endure higher ambient temperatures within the fuel burning region 2, however the lower ratio of fuel to air in the mixture passing out of the vaporizer 8 into the fuel burning region 2 avoids the emission of black smoke that would otherwise be produced by such fuel air ratios.

Figure 4:
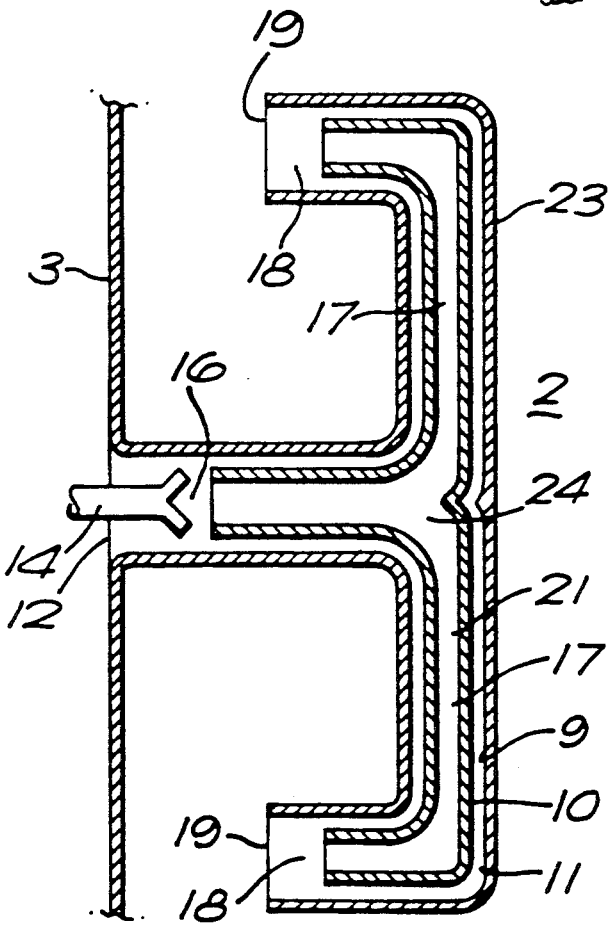
FIG. 4 shows another type of fuel vaporizer embodying the invention in cross-section.

An alternative form of fuel vaporizer 23 is shown in FIG. 4. Where the previous vaporizer 8 was substantially "U" shaped the vaporizer 23 is substantially "W" shaped. Each of the tubes 9 and 10 is bifurcated in the region 24 to produce a vaporizer 23 having a single fixed end 12, first, entry, section 16, two, second, main, sections 17 and two third, exit, sections 18 and free ends 19.

A problem which can arise in the vaporizer design shown in FIG. 4 is that the flow of fuel air mixture in the annular channel 11 can stagnate. This reduces the cooling in the stagnated areas and as a result local overheating or blockage by carbon deposits can occur in the stagnated regions causing thermal fatigue and reducing the life of the vaporizer 23.

It can also be difficult to ensure that equal quantities of fuel pass down each arm of the vapouriser to ensure equal cooling of the two arms.

Figure 5A:
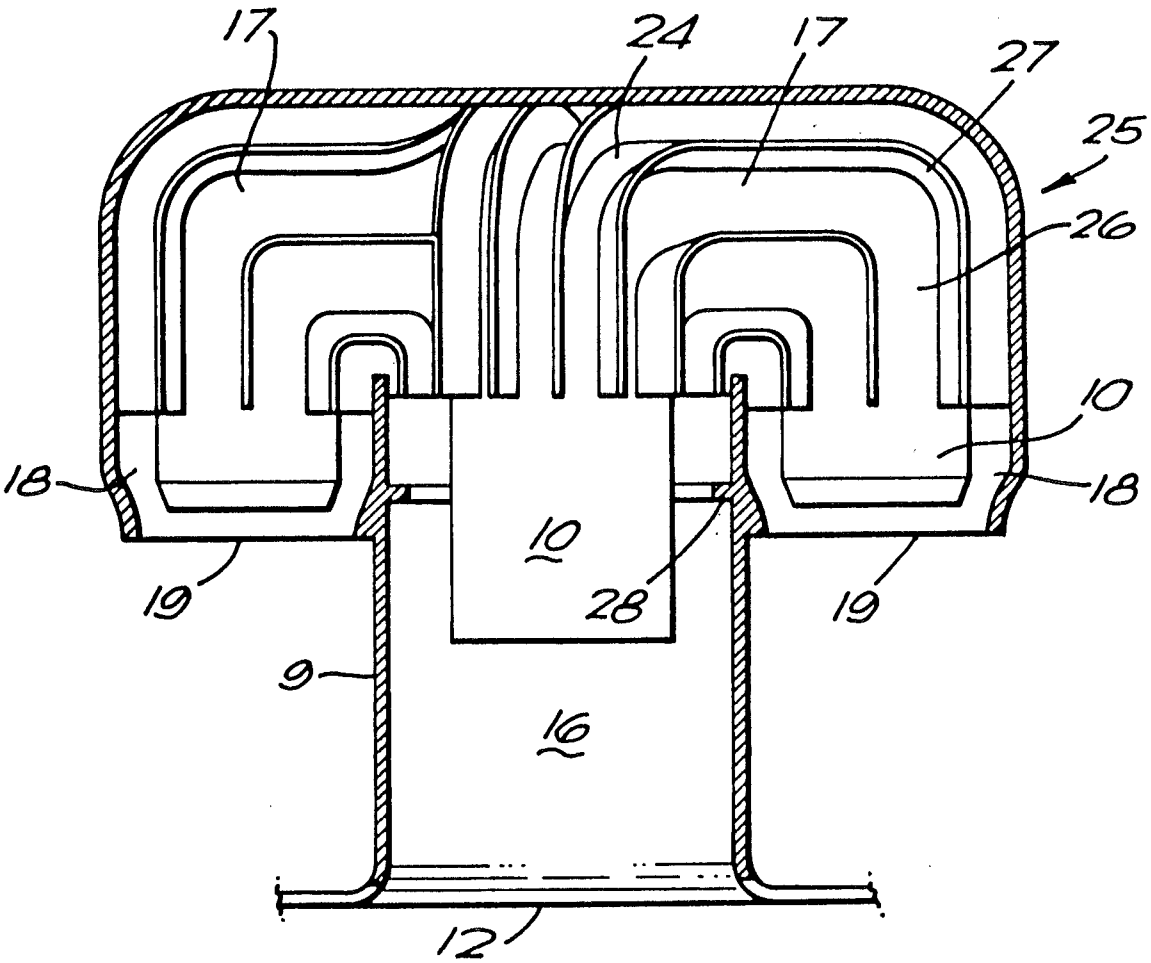
FIG. 5A shows a further type of fuel vaporizer embodying the invention with its outermost tube cut away.
Figure 5B:
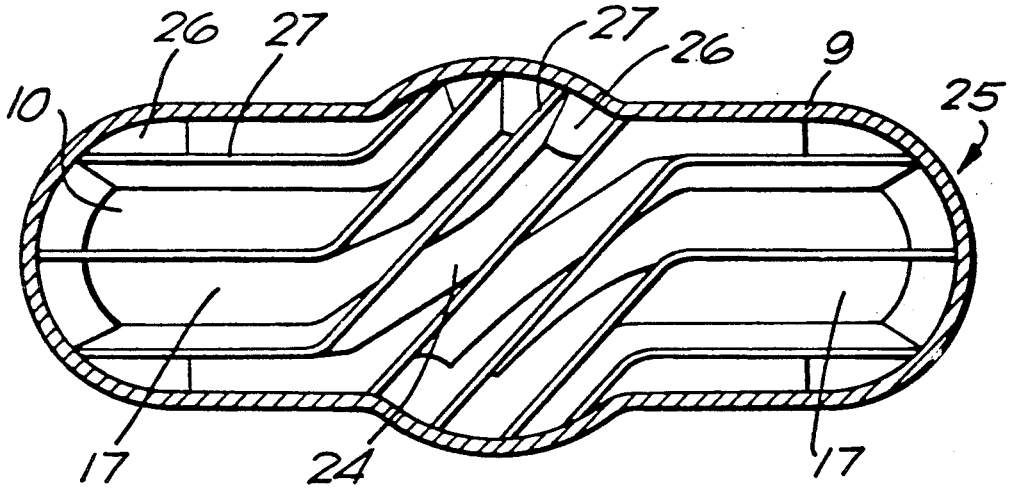
FIG. 5B shows an overhead view of the fuel vaporizer of FIG. 5A with the end of its outermost tube cut away.
Figure 5C:
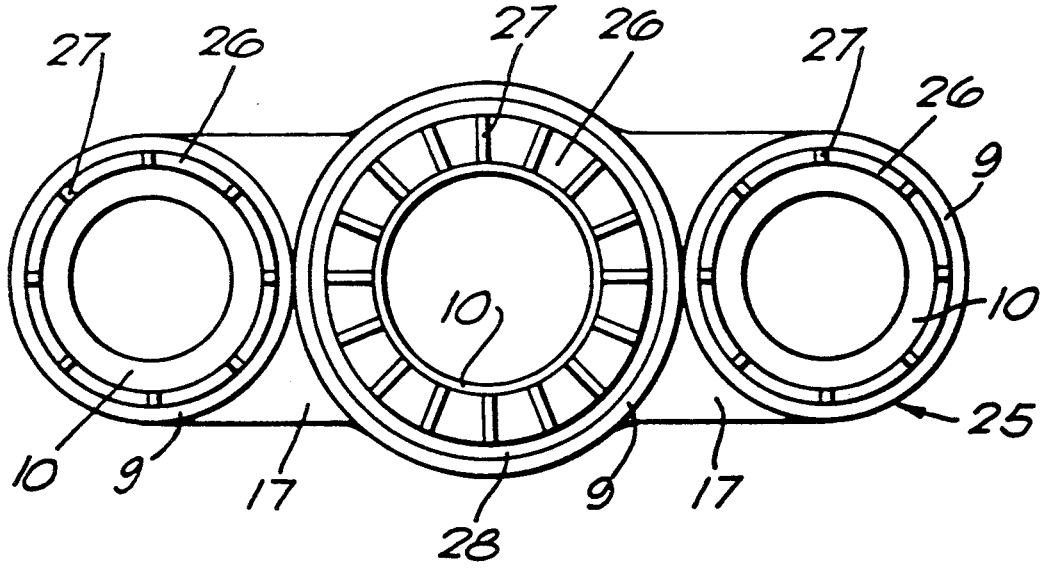
FIG. 5C shows a view of the fuel vaporizer of FIG. 5A from beneath; similar parts having the same reference numerals throughout.

A vaporizer design overcoming this problem is shown in FIG. 5. The vaporizer 25 is substantially the same as the vaporizer of FIG. 4, having an outer tube 9 and an inner tube 10 both bifurcated in a region 24 to give a single fixed end 12, a first, entry section 16, two second, main, sections 17 and two third, exit sections 18 and free ends 19. The circular channel 21 within the inner tube 10 is unchanged. The annular channel 11 between the inner tube 10 and the outer tube 9 is divided into a number of separate channels 26 by 8 strakes 27.

Initially, where the tubes 9 and 10 are single sixteen strakes 27 divide the annular channel 11 into sixteen equally sized passages 26. Eight of these passages 26 carry the fuel air mixture into one bifurcation of the annular channel 11 while eight carry the fuel air mixture into the other bifurcation. In the main regions 17 of the vaporizer each of the two annular channels 11 is divided into eight equally sized passages 26 by eight strakes 27. In the bifurcation region 24, the strakes 27 are arranged so that the passages 26 are volute.

A weir 28 is arranged around the inner circumference of the outer tube 9 in front of the ends of the strakes 27. The weir 28 causes turbulence in the flow of fuel and fuel vapour along the inner surface of the outer tube 9 to ensure that the fuel is distributed evenly among all of the passages 26.

This arrangement ensures good cooling of all of the vaporizer 25.

In the exit sections 18 of the vaporizer 25 the outer tubes 9 and the inner tubes 10 reduce in diameter, this ensures good mixing of the relatively strong fuel air mixture from the annular passage 11 and the relatively weak fuel air mixture from the circular passage 21 before the fuel is burnt.

The weir 28 could be replaced by other turbulence producing structures such as pedestals.

The passages 26 are of differing lengths and so cool different amounts of the surface of the vaporizer 25, additionally the heating experienced by the vaporizer 25 will vary from point to point on its surface, so the amount of heat energy which must be absorbed by the fuel air mixture of each of the channels 26 will be different. As a result it may be preferred to vary the cross sectional areas of the passages 26 along their lengths, give them different entry areas, or arrange that fuel air mixtures of different strengths flow along them in order to ensure satisfactory cooling at all points.

It will be understood that vaporizers employing the invention can be formed with any number of free ends 19 and any number of branchings such as that at 24.

The two tubes 9 and 10 need not be coaxial and could be of any convenient cross-sectional shape or could even have a varying cross-section along their lengths.

Figure 2:
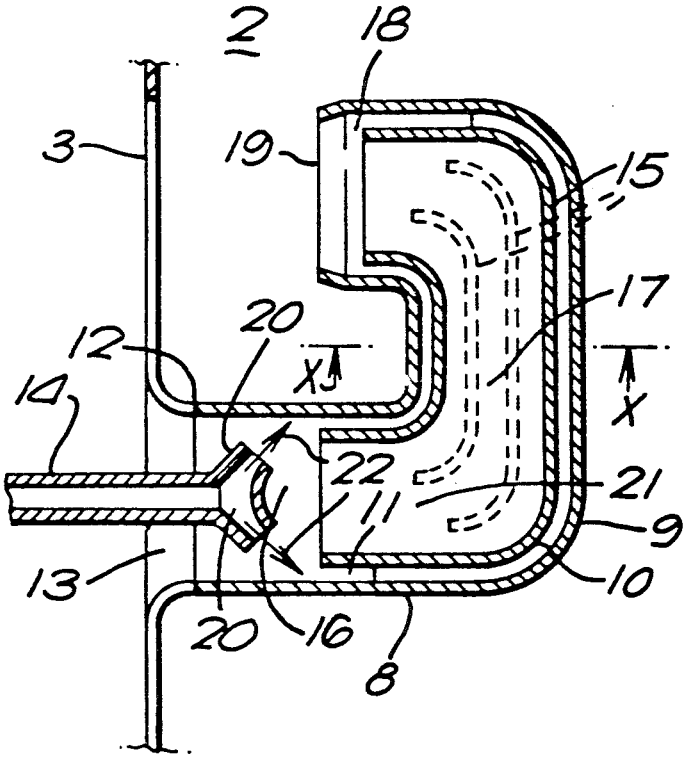
FIG. 2 shows a fuel vaporizer embodying the invention in cross-section.
Figure 3:
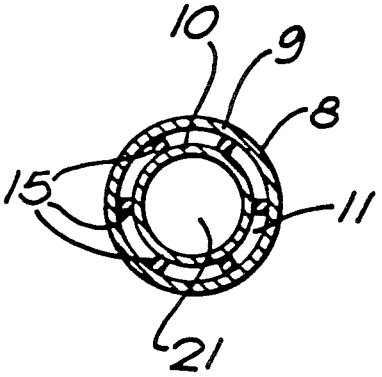
FIG. 3 shows the fuel vaporizer of FIG. 2 in cross-section along the line x—x in FIG. 2.

In the arrangement of FIGS. 2 and 3 it would be possible to not use the fins 15 but to rely on the shaping of the tubes 9 and 10 and the use of structures on the surfaces of the tubes 9 and 10 or passing across the gap between them to control the movement of fuel and fuel vapour in the passage 11 between the two tubes 9 and 10.

In some situations it may be advantageous to place structures in the exit section 18 of the vaporizer 8,23,25 or to alter the shape of the tube 9 to aid mixing of the airstreams from the annular passage 11 and circular passage 12, structures may also be provided within the passages 11 and 12 to encourage such mixing. It may also be advantageous to place structures in the entrance section 16 of the vapouriser 8,23,25 to aid formation of the two separate fuel air mixtures.

It may also be advantageous to provide structures in the entry section 16 of the vapouriser 8,23,25 and in the annular passage 11 to encourage local mixing of air and fuel in order to improve the rate of cooling and heat transfer. These structures or additional structures in the entry section 16 of the vapouriser 8,23,25 and annular passage 11 could also be used to ensure that the fuel from the nozzles 20 is distributed correctly around the annular channel 11.

The two tubes 9 and 10 need not be rigidly connected but could be arranged to have some play between them in order to reduce thermally induced stresses on the vapouriser 8,23,25.

If desired the two tubes could be formed of different materials.

The number of fins 15 used to support the inner tube 10 could of course be varied as required, or support structures of other types, such as rods linking the two tubes 9 and 10, could be used.

It may be found advantageous in some circumstances to have some of the fuel passing down the circular channel 21, this will still work provided the ratio of fuel to air in the annular channel 11 is higher than the ratio of fuel to air in the circular channel 21.

The best ratios of fuel to air in the annular channel 11 and for the vaporizer 8,23,25 as a whole will of course vary depending on the characteristics of the engine and its fuel.

It is not essential for the fuel vapour and air mixture leaving the vaporizer 8,23,25 to be homogenous, provided that before the mixture is burnt sufficient mixing takes place to reduce the highest fuel vapour to air ratios in the mixture below the level at which smoke is produced.

We claim:

1. A fuel vaporizer for a gas turbine engine, the vaporizer comprising a source of air, a fuel injection means, and first and second gas flow tubes, wherein:

(a) said second gas flow tube is located within said first gas flow tube and defines therewith a space between the tubes to allow a first gas flow to flow in said space, a second gas flow to flow within said second gas flow tube, and said fuel injection means injecting fuel into at least one of said first and second gas flows;

(b) said first and second gas flow tubes and said fuel injection means are structured to provide a higher proportion of fuel in said first gas flow than in said second gas flow;

(c) at least one of said first and second gas flow tubes supports at least one projection into said space, said at least one projection being structured to direct said first gas flow in said space and arranged to provide at least two separate gas flow passages in said space; and (d) said first and second gas flow tubes are bifurcated and said at least one projection is structured so that said gas flow passages are volute in the bifurcation region and half of the gas flow passages pass along each bifurcation of said vaporizer.

2. A fuel vaporizer as claimed in claim 1 where the two tubes and the fuel injection means are structured so that said second gas flow contains substantially no fuel.

3. A fuel vaporizer as claimed in claim 1 wherein said first and second gas flows define a downstream end of said vaporizer and the downstream end of said first gas flow tube extends beyond the downstream end of said second gas flow tube and said first and second gas flows mix within the said downstream section of said first gas flow tube.

4. A fuel vaporizer as claimed in claim 1 where said first and second gas flows define an upstream end of the vaporizer and at said upstream end a second section of the first gas flow tube extends beyond and end of said second gas flow tube in an upstream direction and is structured so that within said second section of said first gas flow tube there is a flow of air and said fuel injection means are structured to cause fuel to impinge on an inner wall of said first gas flow tube such that said first and second gas flows are produced.

5. A fuel vaporizer as claimed in claim 1 where said gas flow passages all have equal cross-sectional areas.

6. A fuel vaporizer as claimed in claim 1 where said at least one projection supports said second gas flow tube and is supported by said first gas flow tube.

7. A vaporizer as claimed in claim 1 wherein said at least one projection is a strake.

8. A vaporizer as claimed in claim 1 wherein said first gas flow comprises a mixture of fuel and air and said second gas flow comprises a gas selected from the group consisting of air and a mixture of fuel and air.

* * * * *